US012041959B2

(12) United States Patent
Jochnowitz et al.

(10) Patent No.: US 12,041,959 B2
(45) Date of Patent: Jul. 23, 2024

(54) COMBUSTIBLE HEAT SOURCE COMPRISING CARBON AND CALCIUM PEROXIDE

(71) Applicant: PHILIP MORRIS PRODUCTS S.A., Neuchatel (CH)

(72) Inventors: Evan Jochnowitz, Basel (CH); Farhang Mohseni, Neuchatel (CH); Judith Waller, Ostersund (SE)

(73) Assignee: Philip Morris Products S.A., Neuchatel (CH)

( * ) Notice: Subject to any disclaimer, the term of this patent is extended or adjusted under 35 U.S.C. 154(b) by 233 days.

(21) Appl. No.: 17/778,494

(22) PCT Filed: Dec. 2, 2020

(86) PCT No.: PCT/EP2020/084326

§ 371 (c)(1),
(2) Date: May 20, 2022

(87) PCT Pub. No.: WO2021/110775

PCT Pub. Date: Jun. 10, 2021

(65) Prior Publication Data

US 2022/0408787 A1 Dec. 29, 2022

(30) Foreign Application Priority Data

Dec. 5, 2019 (EP) ..... 19213933

(51) Int. Cl.
*A24B 15/16* (2020.01)
*A24D 1/22* (2020.01)
(Continued)

(52) U.S. Cl.
CPC ..... *A24B 15/165* (2013.01); *A24D 1/22* (2020.01); *C10L 11/04* (2013.01); *A24F 42/10* (2020.01); *C10L 2230/06* (2013.01)

(58) Field of Classification Search
CPC ..... A24B 15/165; A24D 1/22; C10L 11/04; C10L 2230/06
See application file for complete search history.

(56) References Cited

U.S. PATENT DOCUMENTS 5,040,551 A 8/1991 Schlatter
2014/0326260 A1* 11/2014 Gladden ..... A24B 15/165 431/253
2022/0009778 A1* 1/2022 Wyrsta ..... C01B 15/043

FOREIGN PATENT DOCUMENTS

SU 1532547 A * 12/1989
WO WO 2009/074870 12/2008
(Continued)

OTHER PUBLICATIONS

W. H. Philipp and P. A. Kraft. NASA Technical Memorandum 103725. Synthesis and thermal properties of strontium and calcium peroxides. Suppl notes: Prepared for the Annual Meeting of American Institute of Chemical Engineers, San Francisco, California, Nov. 6-8, 1989.

(Continued)

*Primary Examiner* — Christopher M Rodd
*Assistant Examiner* — Jennifer A Kessie
(74) *Attorney, Agent, or Firm* — Mueting Raasch Group

(57) ABSTRACT

A combustible heat source (4) for an aerosol-generating article (2) comprises carbon and calcium peroxide. The calcium peroxide has a purity of greater than or equal to about 90 percent. A method of producing a combustible heat source for an aerosol-generating article, the method comprising the steps of: mixing a carbon material and calcium peroxide having a purity of greater than or equal to about 90 percent; forming the mixture of the carbon material and the calcium peroxide into an elongate rod; and drying the elongate rod.

13 Claims, 1 Drawing Sheet

Figure 1:
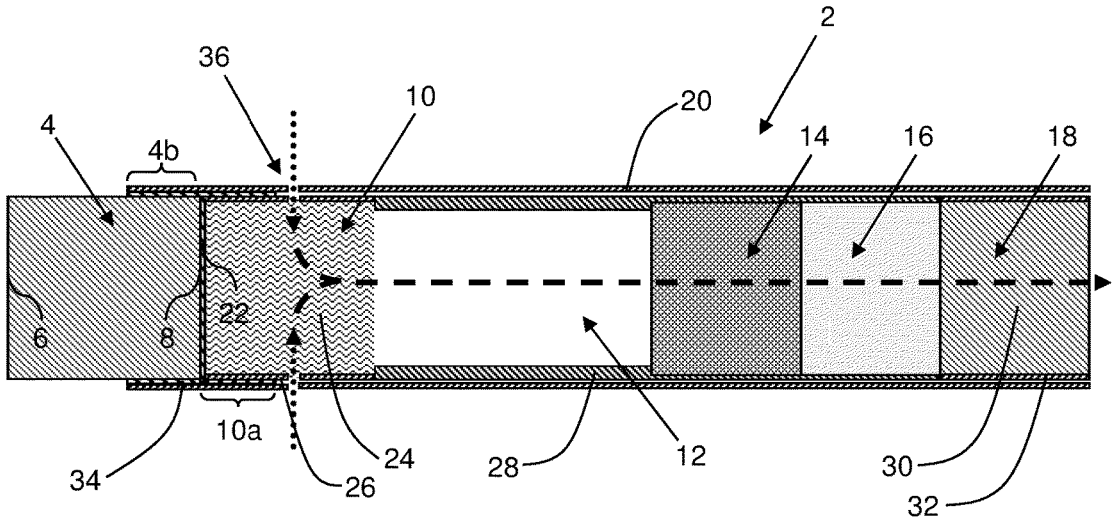

(51) Int. Cl.
*A24F 42/10* (2020.01)
*C10L 11/04* (2006.01)

(56) References Cited

FOREIGN PATENT DOCUMENTS

| | | |
|---|---|---|
| WO | WO 2009/022232 | 2/2009 |
| WO | WO 2012/164077 | 12/2012 |
| WO | WO 2014/006078 | 1/2014 |
| WO | WO 2014/037270 | 3/2014 |
| WO | WO 2019/219869 | 11/2019 |

OTHER PUBLICATIONS

S. Z. Makarov and N. K. Grigor'eva, Production of High-Grade Calcium and Barium Peroxides, Institute of General and Inorganic Chemistry, Academy of Sciences USSR 1959, 2237/2240 dated Dec. 17, 1958.
Extended European Search Report for Application No. 19213933.5 dated May 7, 2022 (8 pages).
PCT Search Report and Written Opinion for Application No. PCT/EP2020/084326 dated Jan. 26, 2021 (9 pages).

* cited by examiner

COMBUSTIBLE HEAT SOURCE COMPRISING CARBON AND CALCIUM PEROXIDE

This application is a U.S. National Stage Application of International Application No. PCT/EP2020/084326 filed Dec. 2, 2020, which was published in English on Jun. 10, 2021, as International Publication No. WO 2021/110775 A1. International Application No. PCT/EP2020/084326 claims priority to European Application No. 19213933.5 filed Dec. 5, 2019.

The invention relates to a combustible heat source for an aerosol-generating article, the combustible heat source comprising carbon and calcium peroxide. The invention further relates to an aerosol-generating article comprising such a combustible heat source and an aerosol-forming substrate.

A number of aerosol-generating articles in which tobacco is heated rather than combusted have been proposed in the art. One aim of such 'heated' aerosol-generating articles is to reduce known harmful smoke constituents of the type produced by the combustion and pyrolytic degradation of tobacco in conventional cigarettes.

In some heated aerosol-generating articles, an aerosol is generated by the transfer of heat from a combustible heat source to a physically separate aerosol-forming substrate. The aerosol-forming substrate may be located within, around or downstream of the combustible heat source. In use, volatile compounds are released from the aerosol-forming substrate by heat transfer from the combustible heat source and entrained in air drawn through the aerosol-generating article. As the released compounds cool, they condense to form an aerosol that is inhaled by the user.

In one type of heated aerosol-generating article, an aerosol is generated by the transfer of heat from a combustible carbonaceous heat source to a physically separate aerosol-forming substrate comprising tobacco material that is located downstream of the combustible carbonaceous heat source. In use, volatile compounds are released from the tobacco material by heat transfer to the aerosol-forming substrate from the combustible carbonaceous heat source and entrained in air drawn through the smoking article. As the released compounds cool, they condense to form an aerosol that is inhaled by the user.

Heat may be transferred from the combustible carbonaceous heat source to the aerosol-forming substrate by one or both of forced convection and conduction.

It is known to include a heat-conducting element around and in direct contact with at least a rear portion of the combustible carbonaceous heat source and at least a front portion of the aerosol-forming substrate of the heated aerosol-generating article in order to ensure sufficient conductive heat transfer from the combustible carbonaceous heat source to the aerosol-forming substrate to obtain an acceptable aerosol. For example, WO 2009/022232 A2 discloses a smoking article comprising a combustible carbonaceous heat source, an aerosol-forming substrate downstream of the combustible heat source, and a heat-conducting element around and in contact with a rear portion of the combustible carbonaceous heat source and an adjacent front portion of the aerosol-forming substrate. In use, heat generated during combustion of the combustible carbonaceous heat source is transferred to the periphery of the front portion of the aerosol-forming substrate by conduction through the abutting downstream end of the combustible carbonaceous heat source and the heat-conducting element.

The combustion temperature of a combustible heat source for use in a heated aerosol-generating article should not be so high as to result in combustion or thermal degradation of the aerosol-forming substrate during use of the heated aerosol-generating article. However, the combustion temperature of the combustible carbonaceous heat source should be sufficiently high to generate enough heat to release sufficient volatile compounds from the aerosol-forming substrate to produce an acceptable aerosol, especially during early puffs.

A variety of combustible carbonaceous heat sources for use in heated aerosol-generating articles are known in the art.

When used in heated aerosol-generating articles, known combustible carbonaceous heat sources often do not generate enough heat after ignition thereof to produce an acceptable aerosol during early puffs.

When used in heated aerosol-generating articles, known combustible carbonaceous heat sources are often difficult to ignite. Failure to properly ignite a combustible carbonaceous heat source of a heated aerosol-generating article may lead to an unacceptable aerosol being delivered to a user.

It has been proposed to include oxidizing agents and other additives in combustible carbonaceous heat sources in order to improve the ignition and combustion properties thereof. For example, WO 2012/164077 A1 discloses a combustible heat source for a smoking article comprising carbon and at least one ignition aid selected from the group consisting of metal nitrate salts having a thermal decomposition temperature of less than about 600° C., chlorates, peroxides, thermitic materials, intermetallic materials, magnesium, zirconium, and combinations thereof.

It would be desirable to provide a combustible carbonaceous heat source comprising an ignition aid for use in an aerosol-generating article that exhibits improved combustion properties compared to known combustible carbonaceous heat sources comprising an ignition aid.

The invention relates to a combustible heat source for an aerosol-generating article. The combustible heat source may comprise carbon. The combustible heat source may comprise calcium peroxide. The calcium peroxide may have a purity of greater than or equal to about 90 percent.

According to the invention there is provided a combustible heat source for an aerosol-generating article, the combustible heat source comprising carbon and calcium peroxide, wherein the calcium peroxide has a purity of greater than or equal to about 90 percent.

According to the invention there is also provided an aerosol-generating article comprising a combustible heat source according to the invention and an aerosol-forming substrate.

According to the invention there is further provided use of calcium peroxide having a purity of greater than or equal to about 90 percent as an ignition aid in a combustible carbonaceous heat source for an aerosol-generating article.

According to the invention there is also further provided a method of producing a combustible heat source, the method comprising the steps of: mixing a carbon material and calcium peroxide having a purity of greater than or equal to about 90 percent; forming the mixture of the carbon material and the calcium peroxide into an elongate rod; and drying the elongate rod.

Combustible heat sources according to the invention comprise calcium peroxide as an ignition aid. When combustible heat sources according to the invention are exposed to a conventional yellow flame lighter or other ignition means, the calcium peroxide in the combustible heat source decomposes to release oxygen. This aids in the ignition of the combustible heat source. The release of oxygen by the calcium peroxide also indirectly causes an initial increase in the temperature of combustible heat source upon ignition thereof by increasing the rate of combustion of the combustible heat source. Following total decomposition of the calcium peroxide, the combustible heat source continues to combust at a lower temperature.

The inclusion of calcium peroxide as an ignition aid thus results in combustible heat sources according to the invention undergoing a two-stage combustion process. That is, in an initial first stage combustible heat sources according to the invention exhibit a 'boost' in temperature and in a subsequent second stage combustible heat sources according to the invention undergo sustained combustion at a lower 'cruising' temperature.

In use in aerosol-generating articles according to the invention comprising an aerosol-forming substrate, the rapid increase in temperature of combustible heat sources according to the invention to the 'boost' temperature may quickly raise the temperature of the aerosol-forming substrate to a level at which volatile compounds are released from the aerosol-forming substrate. This may ensure that aerosol-generating articles according to the invention produce a sensorially acceptable aerosol during early puffs.

The subsequent decrease in temperature of combustible heat sources according to the invention to the 'cruising' temperature may advantageously ensure that the temperature of the aerosol-forming substrate does not reach a level at which combustion or thermal degradation of the aerosol-forming substrate occurs.

Typical commercially available calcium peroxide has a purity of less than or equal to about 80% and contains one or both of calcium hydroxide and calcium oxide. For example, IXPER® 70 C calcium peroxide commercially available from Solvay Chemicals International has a purity of about 73 percent and comprises about 73 percent by weight calcium peroxide ($CaO_2$), about 22 percent by weight calcium hydroxide ($Ca(OH)_2$) and about 5 percent by weight other calcium impurities.

Combustible heat sources according to the invention comprise calcium peroxide having a purity of greater than or equal to 90 percent. As used herein with reference to the invention, "calcium peroxide having a purity of greater than or equal to 90 percent" denotes calcium peroxide containing greater than or equal to 90 percent by dry weight calcium peroxide. In other words, "calcium peroxide having a purity of greater than or equal to 90 percent" denotes calcium peroxide containing less than or equal to 10 percent by dry weight of impurities.

The increased purity of the calcium peroxide in combustible heat sources according to the invention compared to typical commercially available calcium peroxide allows the proportion of calcium peroxide included in combustible heat sources according to the invention in order to achieve a 'boost' in temperature upon ignition thereof to be reduced. This is because, in use, the same amount of oxygen is released upon decomposition of a lesser amount of calcium peroxide having a purity of greater than or equal to 90 percent as from a greater amount of typical commercially available calcium peroxide having a purity of less than or equal to about 80%.

Inclusion of a reduced proportion of calcium peroxide having a purity of greater than or equal to 90 percent in combustible heat sources according to the invention advantageously enables combustible heat sources according to the invention to be produced having an increased proportion of carbon and hence an increased total combustion time compared to combustible heat sources comprising an increased proportion of typical commercially available calcium peroxide having a purity of less than or equal to about 80%.

Without wishing to be bound by theory, it is also believed that the inclusion of calcium peroxide having a purity of greater than or equal to 90 percent in combustible heat sources according to the invention results in improved oxygen diffusion in combustible heat sources according to the invention compared to combustible heat sources comprising typical commercially available calcium peroxide having a purity of less than or equal to about 80%. This is believed to result in more complete combustion of the carbon in combustible heat sources according to the invention compared to combustible heat sources comprising carbon and typical commercially available calcium peroxide having a purity of less than or equal to about 80%.

The inclusion of calcium peroxide having a purity of greater than or equal to 90 percent in combustible heat sources according to the invention may also result in one or both of different combustion by-products and a different ash composition compared to combustible heat sources comprising typical commercially available calcium peroxide having a purity of less than or equal to about 80%.

In addition, calcium peroxide ($CaO_2$) is less reactive than the impurities found in typical commercially available calcium peroxide having a purity of less than or equal to about 80%. Consequently, calcium peroxide having a purity of greater than or equal to 90 percent is more stable during storage than typical commercially available calcium peroxide having a purity of less than or equal to about 80%.

Combustible heat sources according to the invention may comprise calcium peroxide having a purity of greater than or equal to about 92 percent. In certain embodiments, combustible heat sources according to the invention may comprise calcium peroxide having a purity of greater than or equal to about 94 percent or calcium peroxide having a purity of greater than or equal to about 96 percent.

Combustible heat sources according to the invention may comprise calcium peroxide having a purity of less than or equal to about 98 percent.

Combustible heat sources according to the invention may comprise calcium peroxide having a purity of between about 90 percent and about 98 percent. In certain embodiments, combustible heat sources according to the invention may comprise calcium peroxide having a purity of between about 92 percent and about 98 percent or calcium peroxide having a purity of between about 94 percent and about 98 percent or calcium peroxide having a purity of between about 96 percent and about 98 percent.

Calcium peroxide having a purity of greater than or equal to 90 percent for inclusion in combustible heat sources according to the invention may be produced by any suitable method. For example, calcium peroxide having a purity of greater than or equal to 90 percent for inclusion in combustible heat sources according to the invention may be produced the methods described in Production of High-Grade Calcium and Barium Peroxides, S. Z. Makarov and N. K. Grigor'eva, Institute of General and Inorganic Chemistry, Academy of Sciences USSR 1959, 2237-2240 and NASA Technical Memorandum 10375, Synthesis and Thermal Properties of Strontium and Calcium Peroxides, Warren H. Philipp and Patricia A. Kraft, Prepared for the Annual Meeting of the American Institute of Chemical Engineers, San Francisco, California, Nov. 6-8, 1989. Combustible heat sources according to the invention preferably comprise at least about 20 percent by dry weight of calcium peroxide having a purity of greater than or equal to about 90 percent. In certain embodiments, combustible heat sources according to the invention may comprise at least about 30 percent by dry weight of calcium peroxide having a purity of greater than or equal to about 90 percent or at least about 40 percent by dry weight of calcium peroxide having a purity of greater than or equal to about 90 percent.

Combustible heat sources according to the invention preferably comprise less than or equal to about 65 percent by dry weight of calcium peroxide having a purity of greater than or equal to about 90 percent. In certain embodiments, combustible heat sources according to the invention may comprise less than or equal to about 60 percent by dry weight of calcium peroxide having a purity of greater than or equal to about 90 percent or less than or equal to about 55 percent by dry weight of calcium peroxide having a purity of greater than or equal to about 90 percent.

Combustible heat sources according to the invention may comprise between about 20 percent by dry weight and about 65 percent by dry weight of calcium peroxide having a purity of greater than or equal to about 90 percent. In certain embodiments, combustible heat sources according to the invention may comprise between about 30 percent by dry weight and about 60 percent by dry weight of calcium peroxide having a purity of greater than or equal to about 90 percent or between about 40 percent by dry weight and about 55 percent by dry weight of calcium peroxide having a purity of greater than or equal to about 90 percent.

Preferably, the calcium peroxide is distributed substantially homogeneously throughout the combustible heat source.

Combustible heat sources according to the invention are solid combustible heat sources.

Preferably, combustible heat sources are monolithic solid combustible heat sources. That is, one-piece solid combustible heat sources.

Combustible heat sources according to the invention are carbonaceous heat sources.

As used herein with reference to the invention, the term "carbonaceous" is used to describe a combustible heat source comprising carbon.

Combustible heat sources according to the invention comprise carbon as a fuel.

Combustible heat sources according to the invention preferably comprise at least about 35 percent by dry weight of carbon. In certain embodiments, combustible heat sources according to the invention may comprise at least about 40 percent by dry weight of carbon or at least about 45 percent by dry weight of carbon.

Combustible heat sources according to the invention preferably comprise less than or equal to about 80 percent by dry weight. In certain embodiments, combustible heat sources according to the invention may comprise less than or equal to about 70 percent by dry weight of carbon or less than or equal to about 60 percent by dry weight of carbon.

Combustible heat sources according to the invention may comprise between about 35 percent by dry weight and about 80 percent by dry weight of carbon. In certain embodiments, combustible heat sources according to the invention may comprise between about 40 percent by dry weight and about 70 percent by dry weight of carbon or between about 45 percent by dry weight and about 60 percent by dry weight of carbon.

Combustible heat sources according to the invention may be formed using one or more suitable carbon materials. Advantageously, combustible heat sources according to the invention comprise one or more carbonised materials. Suitable carbon materials are well known in the art and include, but are not limited to, carbon powder and charcoal powder.

Combustible heat sources according to the invention preferably further comprise a binding agent.

As used herein with reference to the invention, the term "binding agent" is used to describe a component of the combustible heat source that binds the carbon, and the calcium peroxide having a purity of greater than or equal to about 90 percent and any other components of the combustible heat source together to form a solid combustible heat source that retain its structure.

Combustible heat sources according to the invention may comprise between about 2 percent by dry weight and about 10 percent by dry weight of the binding agent. In certain embodiments, combustible heat sources according to the invention may comprise between about 4 percent by dry weight and about 10 percent by dry weight of the binding agent or between about 5 percent by dry weight and about 9 percent by dry weight of the binding agent.

In certain embodiments, the binding agent may include at least one organic polymeric binder material and at least one carboxylate burn salt.

The inclusion of a binding agent including an organic polymeric binder material and a carboxylate burn salt may advantageously improve the integrity of combustible heat sources according to the invention during and after combustion thereof compared to combustible heat sources comprising only organic binder material.

The term "integrity" is used herein to refer to the ability of combustible heat sources according to the invention to remain whole or intact. Any significant loss of integrity of a combustible heat source can result in cracking or breakage of the combustible heat source. Poor integrity of a combustible heat source may also be indicated by the generation of sparks or flames during lighting of the combustible heat source.

Combustible heat sources according to the invention comprising a binding agent including an organic polymeric binder material and a carboxylate burn salt may exhibit reduced deformation due to combustion compared to combustible heat sources comprising only organic binder material, so that the occurrence of cracks, breakage or fragmentation of the combustible heat source is reduced.

In addition, the inclusion of a binding agent including an organic polymeric binder material and a carboxylate burn salt may advantageously improve the mechanical strength of combustible heat sources according to the invention, as demonstrated by an increase in the compressive strength of the combustible heat source.

The inclusion of a binding agent including an organic polymeric binder material and a carboxylate burn salt in combustible heat sources according to the invention may also result in the formation of a more cohesive ash after combustion of the combustible heat source, so that particles or fragments of the ash are less likely to break away from the combustible heat source. The appearance of the ash may also be improved, with a more uniform consistency and a darker and more uniform colour.

As described further below, the two components of the binding agent each provide a different structure and function within the combustible heat source. Furthermore, the two components of the binding agent each behave differently upon combustion of the combustible heat source. The ratio of the organic polymeric binder material and the carboxylate burn salt in the binding agent can be adjusted in order to modify and improve the combustion properties of the combustible heat source.

The organic polymeric binder is typically formed of long and flexible organic polymers. The organic polymeric binder material is typically a good fuel which improves the combustion properties of combustible heat sources according to the invention. The organic polymeric binder material may also help bind the carbon and the calcium peroxide having a purity of greater than or equal to about 90 percent during production of combustible heat sources according to the invention and prior to combustion thereof. However, the organic polymeric binder material burns away after ignition of the combustible heat source and so does not provide any significant binding effect during or after combustion of the combustible heat source.

The organic polymeric binder material may include any suitable organic polymeric binders that do not produce harmful by-products upon heating or combustion. The organic polymeric binder material may include a single type of organic polymer or a combination of two of more different types of organic polymer. Preferably, the organic polymeric binder material comprises one or more cellulosic polymer materials. Suitable cellulosic polymer materials include but are not limited to cellulose, modified cellulose, methyl cellulose, carboxymethyl cellulose, hydroxypropyl cellulose, hydroxypropyl methylcellulose and combinations thereof. In certain particularly preferred embodiments, the organic polymeric binder material comprises carboxymethyl cellulose (CMC). A suitable source of CMC is available from Phrikolat GmbH, Germany. Alternatively or in addition to the one or more cellulosic polymer materials, the organic polymeric binder material may comprise one or more non-cellulosic polymer materials, including but not limited to gums, such as for example guar gum; wheat flour; starches; sugars; vegetable oils and combinations thereof.

Preferably, the binding agent includes between about 25 percent by dry weight and about 90 percent by dry weight of the organic polymeric binder material, more preferably between about 30 percent by dry weight and about 85 percent by dry weight of the organic polymeric binder material.

The term "carboxylate burn salt" is used herein to refer to a salt of a carboxylic acid, which is believed to modify carbon combustion. Preferably, the carboxylate burn salt comprises a monovalent, divalent, or trivalent cation and a carboxylate anion at room temperature, wherein the carboxylate anion burns when the combustible heat source is lit. More preferably, the carboxylate burn salt is an alkali metal carboxylate burn salt comprising a monovalent alkali metal cation and a carboxylate anion at room temperature, wherein the carboxylate anion burns when the combustible heat source is lit. Specific examples of carboxylate burn salts that may be included in the binding agent include, but are not limited to, alkali metal acetates, alkali metal citrates and alkali metal succinates.

In certain embodiments, the binding agent may include a single carboxylate burn salt. In other embodiments, the binding agent may comprise a combination of two or more different carboxylate burn salts. The two or more different carboxylate burn salts may comprise different carboxylate anions. Alternatively or in addition, the two or more different carboxylate burn salts may comprise different cations. By way of example, the binding agent may comprise a mixture of an alkali metal citrate and an alkaline earth metal succinate.

In contrast to the organic polymeric binder material, the carboxylate burn salt in the binding agent typically comprises ions that are generally smaller in size to the other, larger molecules in combustible heat sources according to the invention. The carboxylate burn salt promotes the combustion of the combustible heat source. In addition, unlike the organic polymeric binder material, the carboxylate burn salt has been found to retain a cohesive structure around the other molecules within the combustible heat source during and after combustion thereof, which helps to bind the components of the combustible heat source together. The carboxylate burn salt may therefore improve the integrity of the combustible heat source during and after combustion thereof and reduce the likelihood of deformation and breakage of the combustible heat source. The retention of the binding effect of the carboxylate burn salt after combustion of the combustible heat source may additionally improve the cohesion and appearance of the ash produced by combustion of the combustible heat source.

The inclusion of a carboxylate burn salt in combustible heat sources according to the invention may additionally provide improvement in the combustion properties of the combustible heat source. In particular, the carboxylate burn salt may increase the combustion time of combustible heat sources according to the invention compared to combustible heat sources including only organic binder material. Furthermore, the promotion of combustion of the combustible heat source by the carboxylate burn salt may enable combustible heat sources according to the invention of a higher density to be used in aerosol-generating articles. This may enable combustible heat sources according to the invention to be produced with a higher quantity of carbon for a combustible heat source of a given size, which may further improve the combustion time of the combustible heat source.

Preferably, the carboxylate burn salt is a potassium or sodium salt of a carboxylic acid such as a citrate, acetate or succinate. In preferred embodiments, the carboxylate burn salt is an alkali metal citrate salt. In particularly preferred embodiments, the carboxylate burn salt is potassium citrate, most preferably mono-potassium citrate or tri-potassium citrate.

The nature of the cation and the nature of the anion selected for the carboxylate burn salt may both have an impact on the combustion properties of the combustible heat source and in particular, on the combustion lifetime, the combustion temperature and the initial temperature during ignition of the combustible heat source. The nature of the carboxylate burn salt and the amount of carboxylate burn salt incorporated into the binding agent can therefore be adjusted depending on the desired combustion properties of combustible heat sources according to the invention.

Preferably, the binding agent comprises between about 5 percent by dry weight and about 50 percent by dry weight of the carboxylate burn salt, more preferably between about 8 percent by dry weight and about 40 percent by dry weight of the carboxylate burn salt.

In certain embodiments, the binding agent may include at least one organic polymeric binder material, at least one carboxylate burn salt and at least one non-combustible inorganic binder material.

As used herein with reference to the invention, the term "non-combustible" is used to describe an inorganic binder material that does not burn or decompose during ignition and combustion of combustible heat sources according to the invention. The non-combustible inorganic binder material is therefore stable at the temperatures to which the binding agent is subjected during combustion of the combustible heat source and will remain substantially intact during and after combustion.

The ratio of the organic polymeric binder material, the carboxylate burn salt and the non-combustible inorganic binder material in the binding agent can be adjusted in order to modify and improve the combustion properties of the combustible heat source.

Preferably, the at least one non-combustible inorganic binder material comprises a sheet silicate material.

The inorganic binder material is preferably formed of a material with relatively large, flat and inflexible molecules. The inorganic binder material is non-combustible at the temperatures reached within combustible heat sources according to the invention during combustion thereof, so that the inorganic binder is still present after ignition and combustion of the combustible heat source. The inorganic binder material therefore retains its binding properties and will continue to bind together the components of the combustible heat source after the organic binder material has been burnt away. At certain levels, the addition of an inorganic binder material may additionally increase the combustion temperature of combustible heat sources according to the invention. The amount of the non-combustible inorganic binder material may be adjusted to increase the combustion temperature of combustible heat sources according to the invention during ignition thereof.

The inorganic binder material may include any suitable inorganic binders that are inert and do not burn or decompose during combustion of the combustible heat source. The non-combustible inorganic binder material may include a single type of inorganic binder or a combination of two of more different types of inorganic binder. Suitable sheet silicate materials for inclusion in the non-combustible inorganic binder material include but are not limited to clays, micas, serpentinites and combinations thereof. In particularly preferred embodiments, the non-combustible inorganic binder material comprises one or more clays. Other suitable inorganic binders include but are not limited to alumina-silicate derivatives, alkali silicates, limestone derivatives, alkaline earth compounds and derivatives, aluminium compounds and derivatives, and combinations thereof.

As used herein with reference to the invention, the term "clay" is used to describe aluminium phyllosilicate materials formed of two dimensional sheets of silicate and aluminate ions, which form a distinct layered structure within the clay. Suitable clays for use in the binding agent of include, but are not limited to, bentonite, montmorillonite and kaolinite. Suitable clays are available from Worlee-Chimie GmbH, Germany or Nanocor.

In particularly preferred embodiments, the non-combustible inorganic binder material comprises one or more exfoliated clays.

As used herein with reference to the invention, the term "exfoliated clays" is used to describe clays which have undergone an exfoliation or delamination process, in which the separation between the layers of silicate and aluminate sheets is increased, in some cases by up to 20 times or more.

The large, flat structure of sheet silicate materials such as clays is in contrast to the long, flexible molecules of the organic binder material and the small ions of the carboxylate burn salt. The combination of binder molecules with these different structures has been found to be effective in providing improved binding properties, not only during production and storage of combustible heat sources according to the invention, but also during and after combustion thereof.

The binding agent may comprise between 0 percent and about 35 percent by dry weight of the non-combustible inorganic binder material. For example, the binding agent may comprise between about 5 percent by dry weight and about 35 percent by dry weight of the non-combustible inorganic binder material or between about 10 percent by dry weight and about 35 percent by dry weight of the non-combustible inorganic binder material.

In certain particularly preferred embodiments, combustible heat sources according to the invention comprise a binding agent including a combination of carboxymethyl cellulose as the organic binder material, potassium citrate as the carboxylate burn salt and clay as the non-combustible inorganic binder material.

The binding agent is preferably incorporated into combustible heat sources according to the invention during production thereof. Where the binding agent includes an organic polymeric binder material and a carboxylate burn salt, a combination of these two components may be incorporated into the combustible heat source in a single step during production or the two components may be incorporated into the heat source in two or three separate steps. Where the binding agent includes an organic polymeric binder material, a carboxylate burn salt and a non-combustible inorganic binder material, a combination of these three components may be incorporated into the combustible heat source in a single step during production or the three components may be incorporated into the heat source in two or three separate steps.

One or more components of the binding agent may be added to the carbon, the calcium peroxide having a purity of greater than or equal to 90 percent and any other components of combustible heat sources according to the invention in the form of a solid, substantially dry powder. Alternatively, one or more components of the binding agent may be added to the carbon, the calcium peroxide having a purity of greater than or equal to 90 percent and any other components of combustible heat sources according to the invention in the form of a solution or slurry comprising the one or more components dissolved or suspended in a suitable solvent, such as water.

Where the binding agent includes an organic polymeric binder material and a carboxylate burn salt or where the binding agent includes an organic polymeric binder material, a carboxylate burn salt and a non-combustible inorganic binder material, at least the carboxylate burn salt is preferably added to the carbon, the calcium peroxide having a purity of greater than or equal to 90 percent and any other components of combustible heat sources according to the invention in the form of a solution. For example, where the carboxylate burn salt comprises potassium citrate, a solution of between about 2 wt. % and 10 wt. % of potassium citrate in water may be used.

Alternatively or in addition to a binding agent, combustible heat sources according to the invention may further comprise one or more additional components to improve the properties thereof. Suitable additional components include, but are not limited to, additives to promote consolidation of the combustible heat source (for example, sintering aids) and additives to promote decomposition of one or more gases produced by combustion of the combustible heat source (for example catalysts, such as CuO, $Fe_2O_3$ and $Al_2O_3$).

Combustible heat sources according to the invention are preferably formed by mixing one or more carbon materials with the calcium peroxide having a purity of greater than or equal to about 90 percent, the binding agent, where included, and any other components and pre-forming the mixture into a desired shape. The mixture of one or more carbon containing materials, the calcium peroxide having a purity of greater than or equal to about 90 percent, the binding agent, where included, and any other components may be pre-formed into a desired shape using any suitable known ceramic forming methods such as, for example, slip casting, extrusion, injection moulding, die compaction or pressing.

Preferably, combustible heat sources according to the invention are formed by a pressing process or an extrusion process. Most preferably, combustible heat sources according to the invention are formed by a pressing process.

Preferably, the mixture of one or more carbon containing materials, the calcium peroxide having a purity of greater than or equal to about 90 percent, the binding agent, where included, and any other components is pre-formed into an elongate rod. However, it will be appreciated that the mixture of one or more carbon containing materials, the calcium peroxide having a purity of greater than or equal to about 90 percent, the binding agent, where included, and any other components may be pre-formed into other desired shapes.

After formation, the elongate rod or other desired shape may be dried to reduce its moisture content.

Combustible heat sources according to the invention preferably have a porosity of between about 20 percent and about 80 percent, more preferably of between about 20 percent and 60 percent. In certain embodiments, combustible heat sources according to the invention may have a porosity of between about 50 percent and about 70 percent or a porosity of between about 50 percent and about 60 percent as measured by, for example, mercury porosimetry or helium pycnometry. A desired porosity may be readily achieved during production of the combustible heat source using conventional methods and technology.

Combustible heat sources according to the invention may have an apparent density of between about 0.6 $g/cm^3$ and about 1.2 $g/cm^3$.

Combustible heat sources according to the invention may have a mass of between about 300 mg and about 500 mg. In certain embodiments, combustible heat sources according to the invention may have a mass of between about 400 mg and about 450 mg.

Combustible heat sources according to the invention preferably have a length of between about 7 mm and about 17 mm, more preferably of between about 7 mm and about 15 mm, most preferably of between about 7 mm and about 13 mm. The term "length" is used herein to refer to the maximum longitudinal dimension of elongate combustible heat sources according to the invention.

Preferably, combustible heat sources according to the invention have a diameter of between about 5 mm and about 9 mm, more preferably of between about 7 mm and about 8 mm. The term "diameter" is used herein to refer to the maximum transverse dimension of elongate combustible heat sources according to the invention.

Preferably, combustible heat sources according to the invention are of substantially uniform diameter. However, combustible heat sources according to the invention may alternatively be tapered.

Preferably, combustible heat sources according to the invention are substantially cylindrical. Cylindrical combustible heat sources according to the invention may be of substantially circular cross-section or of substantially elliptical cross-section.

In certain particularly preferred embodiment, combustible heat sources according to the invention are substantially cylindrical and of substantially circular cross-section.

Combustible heat sources according to the invention may be non-blind combustible heat sources. As used herein with reference to the invention, the term "non-blind" is used to describe a combustible heat source including at least one airflow channel extending along the length of the combustible heat source through which air may be drawn for inhalation by a user.

In aerosol-generating articles according to the invention comprising non-blind combustible heat sources according to the invention heating of the aerosol-forming substrate occurs by conduction and forced convection.

The one or more airflow channels may comprise one or more enclosed airflow channels.

As used herein, the term "enclosed" is used to describe airflow channels that extend through the interior of the non-blind combustible heat source and are surrounded by the non-blind combustible heat source.

Alternatively or in addition, the one or more airflow channels may comprise one or more non-enclosed airflow channels. For example, the one or more airflow channels may comprise one or more grooves or other non-enclosed airflow channels that extend along the exterior of the non-blind combustible heat source.

The one or more airflow channels may comprise one or more enclosed airflow channels or one or more non-enclosed airflow channels or a combination thereof.

In certain embodiments, non-blind combustible heat sources according to the invention comprise one, two or three airflow channels extending from the front face to the rear face of the non-blind combustible heat source.

In certain preferred embodiments, non-blind combustible heat sources according to the invention comprise a single airflow channel extending from the front face to the rear face of the non-blind combustible heat source.

In certain particularly preferred embodiments, non-blind combustible heat sources according to the invention comprise a single substantially central or axial airflow channel extending from the front face to the rear face of the non-blind combustible heat source.

In such embodiments, the diameter of the single airflow channel is preferably between about 1.5 mm and about 3 mm.

It will be appreciated that in addition to one or more airflow channels through which air may be drawn for inhalation by a user, non-blind combustible heat sources according to the invention may comprise one or more closed or blocked passageways through which air may not be drawn for inhalation by a user.

For example, non-blind combustible heat sources according to the invention may comprise one or more airflow channels extending from the front face to the rear face of the combustible heat source and one or more closed passageways that extend from the front face of the non-blind combustible heat source only part way along the length combustible heat source.

The inclusion of one or more closed air passageways increases the surface area of the non-blind combustible heat source that is exposed to oxygen from the air and may advantageously facilitate ignition and sustained combustion of the non-blind combustible heat source.

Alternatively, combustible heat sources according to the invention may be blind combustible heat sources. As used herein with reference to the invention, the term "blind" is used to describe a combustible heat source that does not include any airflow channels extending along the length of the combustible heat source through which air may be drawn for inhalation by a user.

In aerosol-generating articles according to the invention comprising blind combustible heat sources according to the invention heat transfer from the blind combustible heat source to the aerosol-forming substrate occurs primarily by conduction and heating of the aerosol-forming substrate by forced convection is minimised or reduced. This may advantageously help to minimise or reduce the impact of a user's puffing regime on the composition of the mainstream aerosol of aerosol-generating articles according to the invention.

In such embodiments, in use air drawn through the aerosol-generating articles according to the invention for inhalation by a user does not pass through any airflow channels along the blind combustible heat source. The lack of any airflow channels along the blind combustible heat source advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible heat source may also advantageously substantially prevent or inhibit combustion and decomposition products and other materials formed during ignition and combustion of the blind combustible heat source from entering air drawn through aerosol-generating articles according to the invention during use thereof.

It will be appreciated that blind combustible heat sources according to the invention may comprise one or more closed or blocked passageways through which air may not be drawn for inhalation by a user.

For example, blind combustible heat sources according to the invention may comprise one or more closed passageways that extend from the front face at the upstream end of the blind combustible heat source only part way along the length of the blind combustible heat source.

The inclusion of one or more closed air passageways increases the surface area of the blind combustible heat source that is exposed to oxygen from the air and may advantageously facilitate ignition and sustained combustion of the blind combustible heat source.

Aerosol-generating articles according to the invention comprise a combustible heat source according to the invention and an aerosol-forming substrate.

As used herein with reference to the invention, the term "aerosol-forming substrate" is used to describe a substrate comprising aerosol-forming material capable of releasing upon heating volatile compounds, which can form an aerosol. The aerosols generated from aerosol-forming substrates of aerosol-generating articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

Advantageously, the aerosol-forming substrate comprises aerosol-forming material comprising an aerosol-former.

The aerosol former may be any suitable compound or mixture of compounds that, in use, facilitates formation of a dense and stable aerosol and that is substantially resistant to thermal degradation at the operating temperature of the aerosol-generating article. Suitable aerosol formers are known in the art and include, but are not limited to: polyhydric alcohols, such as triethylene glycol, propylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Advantageously, the aerosol former comprises one or more polyhydric alcohols.

More advantageously, the aerosol former comprises glycerine.

Preferably, the aerosol-forming substrate is a solid aerosol-forming substrate. The aerosol-forming substrate may comprise both solid and liquid components.

The aerosol-forming substrate may comprise plant-based material. The aerosol-forming substrate may comprise homogenised plant-based material.

The aerosol-forming substrate may comprise nicotine.

The aerosol-forming substrate may comprise tobacco material.

As used herein with reference to the invention, the term "tobacco material" is used to describe any material comprising tobacco, including, but not limited to, tobacco leaf, tobacco rib, tobacco stem, tobacco stalk, tobacco dust, expanded tobacco, reconstituted tobacco material and homogenised tobacco material.

The tobacco material may, for example, be in the form of powder, granules, pellets, shreds, strands, strips, sheets or any combination thereof.

Advantageously, the aerosol-forming substrate comprises homogenised tobacco material.

As used herein with reference to the invention, the term "homogenised tobacco material" is used to describe a material formed by agglomerating particulate tobacco.

In certain embodiments, the aerosol-forming substrate advantageously comprises a plurality of strands of homogenised tobacco material.

Advantageously, the plurality of strands of homogenised tobacco material may be aligned substantially parallel to one another within the aerosol-forming substrate.

In certain embodiments, the aerosol-forming substrate advantageously comprises a gathered sheet of homogenised tobacco material.

The aerosol-forming substrate may comprise a rod comprising a gathered sheet of homogenised tobacco material.

As used herein with reference to the invention, the term "rod" is used to describe a substantially cylindrical element of substantially circular, oval or elliptical cross-section.

As used herein with reference to the invention, the term "sheet" is used to describe a laminar element having a width and length substantially greater than the thickness thereof.

As used herein with reference to the invention, the term "gathered" is used to describe a sheet that is convoluted, folded, or otherwise compressed or constricted substantially transversely to the longitudinal axis of the aerosol-generating article.

The aerosol-forming substrate may comprise aerosol-forming material and a wrapper around and in contact with the aerosol-forming material.

The wrapper may be formed from any suitable sheet material that is capable of being wrapped around aerosol-forming material to form an aerosol-forming substrate.

In certain embodiments, the aerosol-forming substrate may comprise a rod comprising a gathered sheet of homogenised tobacco material and a wrapper around and in contact with the tobacco material.

In certain embodiments, the aerosol-forming substrate advantageously comprises a gathered textured sheet of homogenised tobacco material.

As used herein with reference to the invention, the term "textured sheet" is used to describe a sheet that has been crimped, embossed, debossed, perforated or otherwise deformed.

Use of a textured sheet of homogenised tobacco material may advantageously facilitate gathering of the sheet of homogenised tobacco material to form the aerosol-forming substrate.

The aerosol-forming substrate may comprise a gathered textured sheet of homogenised tobacco material comprising a plurality of spaced-apart indentations, protrusions, perforations or any combination thereof.

The aerosol-forming substrate may comprise a gathered crimped sheet of homogenised tobacco material.

As used herein with reference to the invention, the term "crimped sheet" is used to describe a sheet having a plurality of substantially parallel ridges or corrugations.

Advantageously, when an aerosol-generating article according to the invention comprising the aerosol-forming substrate has been assembled, the substantially parallel ridges or corrugations extend along or parallel to the longitudinal axis of the aerosol-generating article. This facilitates gathering of the crimped sheet of homogenised tobacco material to form the aerosol-forming substrate.

However, it will be appreciated that crimped sheets of homogenised tobacco material for inclusion in aerosol-forming substrates of aerosol-generating articles according to the invention may alternatively or in addition have a plurality of substantially parallel ridges or corrugations that are disposed at an acute or obtuse angle to the longitudinal axis of the aerosol-generating article when the aerosol-generating article has been assembled.

Preferably, the aerosol-forming substrate is substantially cylindrical.

The aerosol-forming substrate may have a length of between about 5 millimetres and about 20 millimetres.

Preferably, the aerosol-forming substrate has a length of between about 6 millimetres and about 15 millimetres.

More preferably, the aerosol-forming substrate has a length of between about 7 millimetres and about 12 millimetres.

The aerosol-forming substrate may have a diameter of between about 5 millimetres and about 15 millimetres.

Preferably, the aerosol-forming substrate has a diameter of between about 5 millimetres and about 10 millimetres More preferably, the aerosol-forming substrate has a diameter of between about 7 millimetres and about 8 millimetres.

Aerosol-generating articles according to the invention may comprise non-blind combustible heat sources according to the invention or blind combustible heat sources according to the invention.

In particularly preferred embodiments, aerosol-generating articles according to the invention comprise a combustible heat source according to the invention and an aerosol-forming substrate downstream of the combustible heat source.

As used herein with reference to the invention, the terms "distal", "upstream" and "front" and the terms "proximal", "downstream" and "rear" are used to describe the relative positions of components, or portions of components, of aerosol-generating articles according to the invention. Aerosol-generating articles according to the invention comprise a proximal end through which, in use, an aerosol exits the aerosol-generating article for delivery to a user. The proximal end of the aerosol-generating article may also be referred to as the mouth end of the aerosol-generating article. In use, a user draws on the proximal end of the aerosol-generating article in order to inhale an aerosol generated by the aerosol-generating article.

Aerosol-generating articles according to the invention comprise a distal end. The combustible heat source is located at or proximate to the distal end of the aerosol-generating article. The mouth end of the aerosol-generating article is downstream of the distal end of the aerosol-generating article. The proximal end of the aerosol-generating article may also be referred to as the downstream end of the aerosol-generating article and the distal end of the aerosol-generating article may also be referred to as upstream end of the aerosol-generating article. Components, or portions of components, of aerosol-generating articles according to the invention may be described as being upstream or downstream of one another based on their relative positions between the proximal end of the aerosol-generating article and the distal end of the aerosol-generating article.

Combustible heat sources according to the invention have a front end face and a rear end face. The front end face of the combustible heat source is at the upstream end of the combustible heat source. The upstream end of the combustible heat source is the end of the combustible heat source furthest from the proximal end of the aerosol-generating article. The rear end face of the combustible heat source is at the downstream end of the combustible heat source. The downstream end of the combustible heat source is the end of the combustible heat source closest to the proximal end of the aerosol-generating article.

As used herein with reference to the invention, the term "longitudinal" is used to describe the direction between the upstream end and the downstream end of combustible heat sources according to the invention and aerosol-generating articles according to the invention.

As used herein with reference to the invention, the term "transverse" is used to describe the direction perpendicular to the longitudinal direction. That is, the direction perpendicular to the direction between the upstream end and the downstream end of combustible heat sources according to the invention and aerosol-generating articles according to the invention.

As used herein with reference to the invention, the term "length" is used to describe the maximum dimension in the longitudinal direction of combustible heat sources according to the invention and aerosol-generating articles according to the invention.

As used herein with reference to the invention, the term "diameter" is used to describe the maximum dimension in the transverse direction of combustible heat sources according to the invention and aerosol-generating articles according to the invention.

Aerosol-generating articles according to the invention may comprise one or more first air inlets around the periphery of the aerosol-forming substrate.

In such embodiments, in use, cool air is drawn into the aerosol-forming substrate of the aerosol-generating article through the first air inlets. The air drawn into the aerosol-forming substrate through the first air inlets passes downstream through the aerosol-generating article from the aerosol-forming substrate and exits the aerosol-generating article through the proximal end thereof.

In such embodiments, during puffing by a user the cool air drawn through the one or more first air inlets around the periphery of the aerosol-forming substrate advantageously reduces the temperature of the aerosol-forming substrate. This advantageously substantially prevents or inhibits spikes in the temperature of the aerosol-forming substrate during puffing by a user.

As used herein with reference to the invention, the term "cool air" is used to describe ambient air that is not significantly heated by the combustible heat source upon puffing by a user.

By preventing or inhibiting spikes in the temperature of the aerosol-forming substrate, the inclusion of one or more first air inlets around the periphery of the aerosol-forming substrate, advantageously helps to avoid or reduce combustion or pyrolysis of the aerosol-forming substrate under intense puffing regimes. In addition, the inclusion of one or more first air inlets around the periphery of the aerosol-forming substrate advantageously helps to minimise or reduce the impact of a user's puffing regime on the composition of the mainstream aerosol of aerosol-generating articles according to the invention.

The number, shape, size and location of the first air inlets may be appropriately adjusted to achieve a good smoking performance.

In certain embodiments, the aerosol-forming substrate may abut the rear face of the combustible heat source.

As used herein with reference to the invention, the term "abut" is used to describe the aerosol-forming substrate being in direct contact with the rear face of the combustible heat source or a non-combustible substantially air impermeable barrier coating provided on the rear face of the combustible heat source.

In other embodiments, the aerosol-forming substrate may be spaced apart from the rear face of the combustible heat source. That is, there may be a space or gap between the aerosol-forming substrate and the rear face of the combustible heat source.

In such embodiments, alternatively or in addition to one for more first air inlets around the periphery of the aerosol-forming substrate, aerosol-generating articles according to the invention may comprise one or more second air inlets between the rear face of the combustible heat source and the aerosol-forming substrate. In use, cool air is drawn into the space between the combustible heat source and the aerosol-forming substrate through the second air inlets. The air drawn into the space between the combustible heat source and the aerosol-forming substrate through the second air inlets passes downstream through the aerosol-generating article from the space between the combustible heat source and the aerosol-forming substrate and exits the aerosol-generating article through the proximal end thereof.

In such embodiments, during puffing by a user cool air drawn through the one or more second inlets between the rear face of the combustible heat source and the aerosol-forming substrate may advantageously reduce the temperature of the aerosol-forming substrate of aerosol-generating articles according to the invention. This may advantageously substantially prevent or inhibit spikes in the temperature of the aerosol-forming substrate of aerosol-generating articles according to the invention during puffing by a user.

Alternatively or in addition to one or both of one or more first air inlets around the periphery of the aerosol-forming substrate and one or more second inlets between the rear face of the combustible heat source and the aerosol-forming substrate, aerosol-generating articles according to the invention may further comprise one or more third air inlets downstream of the aerosol-forming substrate.

Aerosol-generating articles according to the invention may further comprise a non-combustible substantially air impermeable first barrier between the rear face of the combustible heat source and the aerosol-forming substrate.

As used herein with reference to the invention, the term "non-combustible" is used to describe a barrier that is substantially non-combustible at temperatures reached by the combustible heat source during combustion and ignition thereof.

The first barrier may abut one or both of the rear face of the combustible heat source and the aerosol-forming substrate. Alternatively, the first barrier may be spaced apart from one or both of the rear face of the combustible heat source and the aerosol-forming substrate.

The first barrier may be adhered or otherwise affixed to one or both of the rear face of the combustible heat source and the aerosol-forming substrate.

In certain preferred embodiments, the first barrier comprises a non-combustible substantially air impermeable first barrier coating provided on the rear face of the combustible heat source. In such embodiments, preferably the first barrier comprises a first barrier coating provided on at least substantially the entire rear face of the combustible heat source. More preferably, the first barrier comprises a first barrier coating provided on the entire rear face of the combustible heat source.

As used herein with reference to the invention, the term "coating" is used to describe a layer of material that covers and is adhered to the combustible heat source.

The first barrier may advantageously limit the temperature to which the aerosol-forming substrate is exposed during ignition and combustion of the combustible heat source, and so help to avoid or reduce thermal degradation or combustion of the aerosol-forming substrate during use of the aerosol-generating article.

Inclusion of a non-combustible substantially air impermeable first barrier between the rear face of the combustible heat source and the aerosol-forming substrate may also advantageously substantially prevent or inhibit migration of components of the aerosol-forming substrate of aerosol-generating articles according to the invention to the combustible heat source during storage of the aerosol-generating articles.

Alternatively or in addition, inclusion of a non-combustible substantially air impermeable first barrier between the rear face of the combustible heat source and the aerosol-forming substrate may advantageously substantially prevent or inhibit migration of components of the aerosol-forming substrate of aerosol-generating articles according to the invention to the combustible heat source during use of the aerosol-generating articles.

Inclusion of a non-combustible substantially air impermeable first barrier between the rear face of the combustible heat source and the aerosol-forming substrate may be particularly advantageous where the aerosol-forming substrate comprises at least one aerosol-former.

In such embodiments, inclusion of a non-combustible substantially air impermeable first barrier between the rear face of the combustible heat source and the aerosol-forming substrate may advantageously prevent or inhibit migration of the at least one aerosol-former from the aerosol-forming substrate to the combustible heat source during storage and use of the aerosol-generating article. Decomposition of the at least one aerosol-former during use of the aerosol-generating articles may thus be advantageously substantially avoided or reduced.

Depending upon the desired characteristics and performance of the aerosol-generating article, the first barrier may have a low thermal conductivity or a high thermal conductivity. In certain embodiments, the first barrier may be formed from material having a bulk thermal conductivity of between about 0.1 W per metre Kelvin (W/(m·K)) and about 200 W per metre Kelvin (W/(m·K)), at 23° C. and a relative humidity of 50% as measured using the modified transient plane source (MTPS) method.

The thickness of the first barrier may be appropriately adjusted to achieve good smoking performance. In certain embodiments, the first barrier may have a thickness of between about 10 microns and about 500 microns.

The first barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the first barrier may be formed include clays and glasses. More preferred materials from which the first barrier may be formed include copper, aluminium, stainless steel, alloys, alumina ($Al_2O_3$), resins, and mineral glues.

In certain preferred embodiments, the first barrier comprises a clay coating comprising a 50/50 mixture of bentonite and kaolinite provided on the rear face of the combustible heat source. In other preferred embodiments, the first barrier comprises a glass coating, more preferably a sintered glass coating, provided on the rear face of the combustible heat source.

In certain particularly preferred embodiments, the first barrier comprises an aluminium coating provided on the rear face of the combustible heat source.

Preferably, the first barrier has a thickness of at least about 10 microns.

Due to the slight permeability of clays to air, in embodiments where the first barrier comprises a clay coating provided on the rear face of the combustible heat source, the clay coating more preferably has a thickness of at least about 50 microns, and most preferably of between about 50 microns and about 350 microns.

In embodiments where the first barrier is formed from one or more materials that are more impervious to air, such as aluminium, the first barrier may be thinner, and generally will preferably have a thickness of less than about 100 microns, and more preferably of about 20 microns or about 30 microns.

In embodiments where the first barrier comprises a glass coating provided on the rear face of the combustible heat source, the glass coating preferably has a thickness of less than about 200 microns.

The thickness of the first barrier may be measured using a microscope, a scanning electron microscope (SEM) or any other suitable measurement methods known in the art.

Where the first barrier comprises a first barrier coating provided on the rear face of the combustible heat source, the first barrier coating may be applied to cover and adhere to the rear face of the combustible heat source by any suitable methods known in the art including, but not limited to, spray-coating, vapour deposition, dipping, material transfer (for example, brushing or gluing), electrostatic deposition or any combination thereof.

For example, the first barrier coating may be made by pre-forming a barrier in the approximate size and shape of the rear face of the combustible heat source, and applying it to the rear face of the combustible heat source to cover and adhere to at least substantially the entire rear face of the combustible heat source. Alternatively, the first barrier coating may be cut or otherwise machined after it is applied to the rear face of the combustible heat source. In one preferred embodiment, aluminium foil is applied to the rear face of the combustible heat source by gluing or pressing it to the combustible heat source, and is cut or otherwise machined so that the aluminium foil covers and adheres to at least substantially the entire rear face of the combustible heat source, preferably to the entire rear face of the combustible heat source.

In another preferred embodiment, the first barrier coating is formed by applying a solution or suspension of one or more suitable coating materials to the rear face of the combustible heat source. For example, the first barrier coating may be applied to the rear face of the combustible heat source by dipping the rear face of the combustible heat source in a solution or suspension of one or more suitable coating materials or by brushing or spray-coating a solution or suspension or electrostatically depositing a powder or powder mixture of one or more suitable coating materials onto the rear face of the combustible heat source. Where the first barrier coating is applied to the rear face of the combustible heat source by electrostatically depositing a powder or powder mixture of one or more suitable coating materials onto the rear face of the combustible heat source, the rear face of the combustible heat source is preferably pre-treated with water glass before electrostatic deposition. Preferably, the first barrier coating is applied by spray-coating.

The first barrier coating may be formed through a single application of a solution or suspension of one or more suitable coating materials to the rear face of the combustible heat source. Alternatively, the first barrier coating may be formed through multiple applications of a solution or suspension of one or more suitable coating materials to the rear face of the combustible heat source. For example, the first barrier coating may be formed through one, two, three, four, five, six, seven or eight successive applications of a solution or suspension of one or more suitable coating materials to the rear face of the combustible heat source.

Preferably, the first barrier coating is formed through between one and ten applications of a solution or suspension of one or more suitable coating materials to the rear face of the combustible heat source.

After application of the solution or suspension of one or more coating materials to the rear face thereof, the combustible heat source may be dried to form the first barrier coating.

Where the first barrier coating is formed through multiple applications of a solution or suspension of one or more suitable coating materials to the rear face thereof, the combustible heat source may need to be dried between successive applications of the solution or suspension.

Alternatively or in addition to drying, after application of a solution or suspension of one or more coating materials to the rear face of the combustible heat source, the coating material on the combustible heat source may be sintered in order to form the first barrier coating. Sintering of the first barrier coating is particularly preferred where the first barrier coating is a glass or ceramic coating. Preferably, the first barrier coating is sintered at a temperature of between about 500° C. and about 900° C., and more preferably at about 700° C.

Where aerosol-generating articles according to the invention comprise a non-blind combustible heat source according to the invention and a non-combustible, substantially air impermeable first barrier between the rear face of the combustible heat source and the aerosol-forming substrate, the first barrier should allow air entering the aerosol-generating article through the one or more airflow channels to be drawn downstream through the aerosol-generating article.

Alternatively or in addition to a non-combustible, substantially air impermeable first barrier between the rear face of the combustible heat source and the aerosol-forming substrate, aerosol-generating articles according to the invention comprising a non-blind combustible heat source may comprise a non-combustible substantially air impermeable second barrier between the non-blind combustible heat source and the one or more airflow channels.

The second barrier may advantageously substantially prevent or inhibit combustion and decomposition products formed during ignition and combustion of the non-blind combustible heat source from entering air drawn into aerosol-generating articles according to the invention through the one or more airflow channels as the drawn air passes through the one or more airflow channels.

Inclusion of a non-combustible substantially air impermeable second barrier between the non-blind combustible heat source and the one or more airflow channels may also advantageously substantially prevent or inhibit activation of combustion of the non-blind combustible heat source during puffing by a user. This may substantially prevent or inhibit spikes in the temperature of the aerosol-forming substrate during puffing by a user.

By preventing or inhibiting activation of combustion of the non-blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The second barrier may be adhered or otherwise affixed to the non-blind combustible heat source.

In certain preferred embodiments, the second barrier comprises a non-combustible substantially air impermeable second barrier coating provided on an inner surface of the one or more airflow channels. In such embodiments, preferably the second barrier comprises a second barrier coating provided on at least substantially the entire inner surface of the one or more airflow channels. More preferably, the second barrier comprises a second barrier coating provided on the entire inner surface of the one or more airflow channels.

In other embodiments, the second barrier coating may be provided by insertion of a liner into the one or more airflow channels. For example, where the one or more airflow channels comprise one or more enclosed airflow channels that extend through the interior of the non-blind combustible heat source, a non-combustible substantially air impermeable hollow tube may be inserted into each of the one or more airflow channels.

Depending upon the desired characteristics and performance of the aerosol-generating article, the second barrier may have a low thermal conductivity or a high thermal conductivity. Preferably, the second barrier has a low thermal conductivity.

The thickness of the second barrier may be appropriately adjusted to achieve good smoking performance. In certain embodiments, the second barrier may have a thickness of between about 30 microns and about 200 microns. In a preferred embodiment, the second barrier has a thickness of between about 30 microns and about 100 microns.

The second barrier may be formed from one or more suitable materials that are substantially thermally stable and non-combustible at temperatures achieved by the non-blind combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the second barrier may be formed include clays, glasses, aluminium, iron oxide and combinations thereof. If desired, catalytic ingredients, such as ingredients that promote the oxidation of carbon monoxide to carbon dioxide, may be incorporated in the second barrier. Suitable catalytic ingredients include, but are not limited to, for example, platinum, palladium, transition metals and their oxides.

Where the second barrier comprises a second barrier coating provided on an inner surface of the one or more airflow channels, the second barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the second barrier coating. In certain preferred embodiments, the second barrier coating is applied to the inner surface of the one or more airflow channels by the process described in WO 2009/074870 A2 as the combustible heat source is extruded.

Preferably, aerosol-generating articles according to the invention further comprise one or more heat-conducting elements around at least a rear portion of the combustible heat source and at least a front portion of the aerosol-forming substrate. The one or more heat-conducting elements are preferably combustion resistant. In certain embodiments, the one or more heat conducting element may be oxygen restricting. In other words, the one or more heat-conducting elements may inhibit or resist the passage of oxygen through the heat-conducting element to the combustible heat source.

Aerosol-generating articles according to the invention may comprise a heat-conducting element in direct contact with both at least a rear portion of the combustible heat source and at least a front portion of the aerosol-forming substrate. In such embodiments, the heat-conducting element provides a thermal link between the combustible heat source and the aerosol-forming substrate of aerosol-generating articles according to the invention.

Alternatively or in addition, aerosol-generating articles according to the invention may comprise a heat-conducting element spaced apart from one or both of the combustible heat source and the aerosol-forming substrate, such that there is no direct contact between the heat-conducting element and one or both of the combustible heat source and the aerosol-forming substrate.

Suitable heat-conducting elements for use in aerosol-generating articles according to the invention include, but are not limited to: metal foil wrappers such as, for example, aluminium foil wrappers, steel wrappers, iron foil wrappers and copper foil wrappers; and metal alloy foil wrappers.

Aerosol-generating articles according to the invention preferably comprise a mouthpiece located at the proximal end thereof.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Aerosol-generating articles according to the element preferably further comprise a transfer element or spacer element between the aerosol-forming substrate and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of aerosol-generating articles according to the invention to be adjusted to a desired value, for example to a length similar to that of conventional cigarettes, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the aerosol-generating article, and the presence and length of other components within the aerosol-generating article.

Preferably, the transfer element comprises at least one open-ended tubular hollow body. In such embodiments, in use, air drawn into the aerosol-generating article passes through the at least one open-ended tubular hollow body as it passes downstream through the aerosol-generating article from the aerosol-forming substrate to the mouthpiece.

The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Alternatively or in addition, aerosol-generating articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Aerosol-generating articles according to the invention may be assembled using known methods and machinery.

Figure 2:
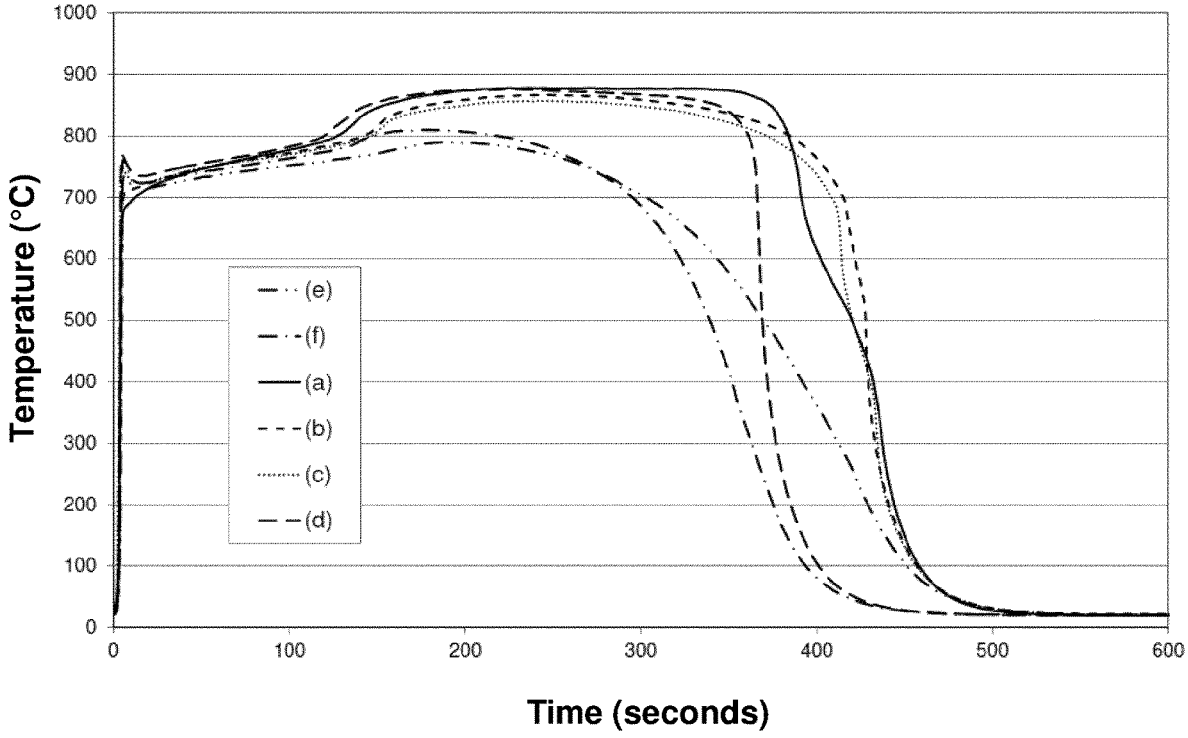

The invention will be further described, by way of example only, with reference to the accompanying drawings in which:

FIG. 1 shows a schematic longitudinal cross-section of an aerosol-generating article according to an embodiment of the invention; and FIG. 2 shows a graph of the temperature profiles of combustible heat sources according to the invention and the temperature profiles of comparative combustible heat sources.

The aerosol-generating article 2 according to the embodiment of the invention shown in FIG. 1 comprises a combustible heat source 4 according to the invention and an aerosol-forming substrate 10 downstream of the combustible heat source 4. The combustible heat source 4 is a blind combustible heat source having a front end face 6 and an opposed rear end face 8 and is located at the distal end of the aerosol-generating article 2. The aerosol-generating article 2 further comprises a transfer element 12, an aerosol-cooling element 14, a spacer element 16 and a mouthpiece 18. The combustible heat source 4, aerosol-forming substrate 10, transfer element 12, aerosol-cooling element 14, spacer element 16 and mouthpiece 18 are arranged in abutting coaxial alignment. As shown in FIG. 1, the aerosol-forming substrate 10, transfer element 12, aerosol-cooling element 14, spacer element 16 and mouthpiece 18 and a rear portion of the combustible heat source 4 are wrapped in an outer wrapper 20 of sheet material such as, for example, cigarette paper.

As shown in FIG. 1, a non-combustible substantially air impermeable barrier 22 in the form of a disc of aluminium foil is provided between the rear end face 8 of the combustible heat source 4 and the aerosol-forming substrate 10. The barrier 22 is applied to the rear end face 8 of the combustible carbonaceous heat source 4 by pressing the disc of aluminium foil onto the rear end face 8 of the combustible heat source 4 and abuts the rear end face 8 of the combustible carbonaceous heat source 4 and the aerosol-forming substrate 10.

The combustible heat source 4 comprises carbon and calcium peroxide, wherein the calcium peroxide has a purity of greater than or equal to about 90 percent.

The aerosol-forming substrate 10 is located immediately downstream of the barrier 22 applied to the rear end face 8 of the combustible heat source 4. The aerosol-forming substrate 10 comprises a gathered crimped sheet of homogenised tobacco material 24 and a wrapper 26 around and in direct contact with the gathered crimped sheet of homogenised tobacco material 24. The gathered crimped sheet of homogenised tobacco material 24 comprises a suitable aerosol former such as, for example, glycerine.

The transfer element 12 is located immediately downstream of the aerosol-forming substrate 10 and comprises a cylindrical open-ended hollow cellulose acetate tube 28.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube.

The mouthpiece 18 is located immediately downstream of the spacer element 16. As shown in FIG. 1, the mouthpiece 18 is located at the proximal end of the aerosol-generating article 2 and comprises a cylindrical plug of suitable filtration material 30 such as, for example, cellulose acetate tow of very low filtration efficiency, wrapped in filter plug wrap 32.

The aerosol-generating article may further comprise a band of tipping paper (not shown) circumscribing a downstream end portion of the outer wrapper 20.

As shown in FIG. 1, the aerosol-generating article 2 further comprises a heat-conducting element 34 formed from a suitable thermally conductive material such as, for example, aluminium foil around and in contact with a rear portion 4*b* of the combustible heat source 4 and a front portion 10*a* of the aerosol-forming substrate 10. In the aerosol-generating article 2 according to the embodiment of the invention shown in FIG. 1, the aerosol-forming substrate 10 extends downstream beyond the heat-conducting element 34. That is, the heat-conducting element 34 is not around and in contact with a rear portion of the aerosol-forming substrate 10. However, it will be appreciated that in other embodiments of the invention (not shown), the heat-conducting element 34 may be around and in contact with the entire length of the aerosol-forming substrate 10. It will also be appreciated that in other embodiments of the invention (not shown), one or more additional heat-conducting elements may be provided that overlie the heat-conducting element 34.

The aerosol-generating article 2 according to the embodiment of the invention shown in FIG. 1 comprises one or more air inlets 36 around the periphery of the aerosol-forming substrate 10. As shown in FIG. 1, a circumferential arrangement of air inlets 36 is provided in the wrapper 26 of the aerosol-forming substrate 10 and the overlying outer wrapper 20 to admit cool air (shown by dotted arrows in FIG. 1) into the aerosol-forming substrate 10.

In use, a user ignites the combustible carbonaceous heat source 4. Once the combustible carbonaceous heat source 4 is ignited the user draws on the mouthpiece 18 of the aerosol-generating article 2. When a user draws on the mouthpiece 18, cool air (shown by dotted arrows in FIG. 1) is drawn into the aerosol-forming substrate 10 of the aerosol-generating article 2 through the air inlets 36.

The periphery of the front portion 10*a* of the aerosol-forming substrate 10 is heated by conduction through the rear end face 8 of the combustible heat source 4 and the barrier 22 and through the heat-conducting element 34.

The heating of the aerosol-forming substrate 10 by conduction releases aerosol former and other volatile and semi-volatile compounds from the gathered crimped sheet of homogenised tobacco material 24. The compounds released from the aerosol-forming substrate 10 form an aerosol that is entrained in the air drawn into the aerosol-forming substrate 10 of the aerosol-generating article 2 through the air inlets 36 as it flows through the aerosol-forming substrate 10. The drawn air and entrained aerosol (shown by dashed arrows in FIG. 1) pass downstream through the interior of the cylindrical open-ended hollow cellulose acetate tube 28 of the transfer element 12, the aerosol-cooling element 14 and the spacer element 16, where they cool and condense. The cooled drawn air and entrained aerosol pass downstream through the mouthpiece 18 and are delivered to the user through the proximal end of the aerosol-generating article 2. The non-combustible substantially air impermeable barrier 22 on the rear end face 8 of the combustible carbonaceous heat source 4 isolates the combustible heat source 4 from air drawn through the aerosol-generating article 2 such that, in use, air drawn through the aerosol-generating article 2 does not come into direct contact with the combustible heat source 4.

Combustible heat sources according to a first embodiment of the invention are produced in accordance with Example 1 below.

EXAMPLE 1

A combustible heat source according to the invention having the composition shown in Table 1 is prepared by the method described below.

TABLE 1

| Component | Function | Amount (g) | Percentage on a dry weight basis |
|---|---|---|---|
| Charcoal | Combustible fuel | 1020 | 51.0 |
| Calcium peroxide (92 percent purity) | Ignition aid | 840 | 42.0 |
| Carboxymethyl cellulose | Organic polymeric binder | 94 | 4.7 |
| Tri-potassium citrate | Carboxylate burn salt | 40 | 2.0 |
| Bentonite | Non-combustible inorganic binder | 6 | 0.3 |
| Total | | 2000 | 100.0 |

The powdered raw materials listed under Mix A in Table 2 (charcoal, calcium peroxide and carboxymethyl cellulose) are pre-blended in a mixer. A first granulation fluid is prepared by dissolution of the remaining raw materials listed under Mix A in Table 2 in water (potassium citrate (4% solution in water)). The pre-blended powdered raw materials are introduced into a fluidized bed reactor and the air flow adjusted to keep the pre-blended powdered raw materials in air suspension. The first granulation fluid is pumped (typically at a fluid rate of 50 to 70 ml/min) into a nozzle and atomized with compressed air in a spray that is added onto the air fluidized pre-blended powdered raw materials.

TABLE 2

| Raw Material | Function | Mix A Amount (g) | Mix B Amount (g) |
|---|---|---|---|
| Charcoal | Combustible fuel | 1020 (powder) | — |
| Calcium peroxide (92 percent purity) | Ignition aid | 840 (powder) | |
| Carboxymethyl cellulose | Organic polymeric binder | 94 (powder) | — |
| Tri-potassium citrate | Carboxylate burn salt | 40 (solution) | — |
| Bentonite | Non-combustible inorganic binder | — | 6 (slurry) |
| Water | | 1000 | 400 |

A second granulation fluid is prepared by dissolution of the remaining raw material listed under Mix B in Table 2 in water (bentonite (1.5% slurry in water)). The second granulation fluid is pumped (typically at a fluid rate of 50 to 70 ml/min) into a nozzle and atomized with compressed air in a spray. The atomized second granulation fluid is combined with the raw materials of Mix A to form granules. The granules are air dried, typically at ambient temperature, 60 or 80° C., and the level of residual moisture is controlled by weight, typically 24-28%). The granules are sieved through a 0.8 to 1.0 mm sieve to remove chunks.

The granules are moulded to form cylindrical combustible heat sources having a length of about 9 mm and a diameter of about 7.8 mm. Moulding is operated with a single cavity press equipped with an automated feeding system. The force of compaction is <2 KN for a cycle time of 3 s/stroke. Optionally, a disc of aluminium foil, typically about 20 μm thickness, is punched onto the upper surface of the combustible heat source during the compaction stroke. In such embodiments, a coating of carboxymethyl cellulose covering the surface of the aluminium foil may be used for good adhesion. The punch is designed with a chamfer and with a specific diameter to reduce the risk of aluminium loss during pressing. The diameter of the punch is designed to create a clearance with the mould cavity surface that corresponds to the aluminium foil thickness. The moulded combustible heat sources are dried in an oven for about 30 minutes at about 100° C.

The temperature of combustible heat sources according to the invention having the compositions shown in Examples (a) to (d) of Table 3 are measured using a thermocouple inserted into the middle of the combustible heat sources. To generate the profiles, the combustible heat sources are ignited using a conventional yellow flame lighter. The results are shown in FIG. 2.

TABLE 3

| Component (percentage on a dry weight basis) | Examples | | | | Comparative Examples | |
|---|---|---|---|---|---|---|
| | (a) | (b) | (c) | (d) | (e) | (f) |
| Charcoal | 57.4 | 55.2 | 53.4 | 51.5 | 47.5 | 45.5 |
| Calcium peroxide (96 percent purity) | 36.0 | 38.0 | 40.0 | 42.0 | 0.0 | 0.0 |
| Calcium peroxide (75 percent purity) | 0.0 | 0.0 | 0.0 | 0.0 | 48.0 | 50.0 |
| Calcium hydroxide | 0.4 | 0.4 | 0.4 | 0.4 | 0.0 | 0.0 |
| Carboxymethyl cellulose | 3.7 | 3.9 | 3.7 | 3.6 | 3.7 | 3.7 |
| Tri-potassium citrate | 1.0 | 1.0 | 1.0 | 1.0 | 0.0 | 0.0 |
| Bentonite | 1.5 | 1.5 | 1.5 | 1.5 | 0.8 | 0.8 |
| Total | 100.0 | 100.0 | 100.0 | 100.0 | 100.0 | 100.0 |

For the purposes of comparison, the temperature of comparative combustible heat sources having the compositions shown in Comparative Examples (e) and (f) of Table 3 are measured under similar experimental conditions. The comparative combustible heat sources are the same size and mass as the combustible heat sources according to the invention and are produced in the same manner as the combustible heat sources according to the invention. The results are also shown in FIG. 2.

As shown in FIG. 2, the combustible heat sources according to the invention comprising (a) 36% by dry weight of calcium peroxide having a purity of 96 percent, (b) 38% by dry weight of calcium peroxide having a purity of 96 percent, (c) 40% by dry weight of calcium peroxide having a purity of 96 percent and (d) 42% by dry weight of calcium peroxide having a purity of 96 percent advantageously exhibit a longer combustion lifetime than the comparative combustible heat sources comprising (e) 48% by dry weight of calcium peroxide having a purity of about 73 percent and (f) 50% by dry weight of calcium peroxide having a purity of about 73 percent. These results demonstrate an improvement in the combustion properties of the combustible heat sources according to the invention provided through the use of calcium peroxide having a purity of at least 90 percent, as described above.

The specific embodiments and examples described above illustrate but do not limit the invention. It is to be understood that other embodiments of the invention may be made and the specific embodiments and examples described herein are not exhaustive.

The invention claimed is:

1. A combustible heat source for an aerosol-generating article, the combustible heat source comprising carbon and calcium peroxide, wherein the calcium peroxide has a purity of greater than or equal to about 90 percent.

2. A combustible heat source according to claim 1 wherein the calcium peroxide has a purity of between about 90 percent and about 98 percent.

3. A combustible heat source according to claim 1 wherein the calcium peroxide has a purity of between about 92 percent and about 98 percent.

4. A combustible heat source according to claim 1 comprising at least about 20 percent by dry weight of the calcium peroxide.

5. A combustible heat source according to claim 1 comprising between about 20 percent by dry weight and about 65 percent by dry weight of the calcium peroxide.

6. A combustible heat source according to claim 1 comprising at least about 35 percent by dry weight of the carbon.

7. A combustible heat source according to claim 1 comprising between about 35 percent by dry weight and about 80 percent by dry weight of the carbon.

8. A combustible heat source according to claim 1 further comprising a binding agent.

9. A combustible heat source according to claim 8 wherein the binding agent includes at least one organic polymeric binder material and at least one carboxylate burn salt.

10. A combustible heat source according to claim 8 comprising between about 2 percent by dry weight and about 10 percent by dry weight of the binding agent.

11. A combustible heat source according to claim 1 wherein the combustible heat source is formed by a pressing process.

12. An aerosol-generating article comprising a combustible heat source according to claim 1 and an aerosol-forming substrate.

13. A method of producing a combustible heat source for an aerosol-generating article, the method comprising the steps of:

mixing a carbon material and calcium peroxide having a purity of greater than or equal to about 90 percent;

forming the mixture of the carbon material and the calcium peroxide into an elongate rod; and drying the elongate rod.

* * * * *